United States Patent [19]

Foshee

[11] 4,342,478

[45] Aug. 3, 1982

[54] KNOB-CONNECTOR SPRING

[75] Inventor: William R. Foshee, Indianapolis, Ind.

[73] Assignee: Best Lock Corporation, Indianapolis, Ind.

[21] Appl. No.: 163,472

[22] Filed: Jun. 27, 1980

[51] Int. Cl.[3] ..... E05C 21/00

[52] U.S. Cl. ..... 292/352

[58] Field of Search ..... 292/352, 353, 359; 70/368

[56] References Cited

U.S. PATENT DOCUMENTS

| | | | |
|---|---|---|---|
| 2,062,765 | 12/1936 | Schloge | 70/91 |
| 2,517,240 | 8/1950 | Roberts | 292/353 |
| 2,814,194 | 11/1957 | North et al. | 70/146 |
| 3,779,590 | 12/1973 | Sanders et al. | 292/336.3 |
| 3,955,387 | 5/1976 | Best et al. | 70/224 |

FOREIGN PATENT DOCUMENTS

| | | | |
|---|---|---|---|
| 1119714 | 12/1961 | Fed. Rep. of Germany | 292/353 |

*Primary Examiner*—Richard E. Moore

*Attorney, Agent, or Firm*—Jenkins, Coffey, Hyland, Badger & Conard

[57] ABSTRACT

A biasing spring especially for a doorknob keeper or other knob to knob-sleeve connector and the combination thereof with a knob connector of any of various types, but in particular a plate mounted for radial movement in a plane normal to the axis of a knob sleeve and having a lug projecting radially into engagement with a surrounding knob portion. The spring has a central angular bight embracing a central tongue on the retainer plate at one side of the sleeve, and side legs straddling a central clearance space in the knob sleeve and extending into stressed camming engagement with converging inside faces of the opposite half of the sleeve. The spring legs may have end portions interlocked with the plate to secure the spring in place, or may be otherwise retained.

16 Claims, 8 Drawing Figures

KNOB-CONNECTOR SPRING

This invention relates to a biasing spring for a knob-connector lug, such as a keeper or driver lug, for retaining or connecting a doorknob to a knob spindle or sleeve, especially a tubular sleeve requiring a clearance space along its axis, and to a combination of such spring with related connector and lock mechanism.

In accordance with the invention, means for connecting a doorknob on a tubular knob sleeve or the like comprises a connector lug mounted for movement radially of the knob sleeve to a knob-connecting position, and means for biasing the lug to such retaining position, and such biasing means comprises a wire spring having a central bight portion in outward radial thrust relation with the lug and disposed adjacent one side of the knob sleeve, and having side legs connected to the bight portion and extending therefrom in free-clearance relation across to the opposite side of the knob sleeve and there engaged in spaced lateral thrust relation with inside camming surfaces of the sleeve so that the lateral thrust of the spring legs reacts against such surfaces to produce a component of force on the spring and the lug in the direction of outward radial movement of the connector lug. Desirably, the side legs of the spring straddle a central clearance area adjacent the axis of the knob sleeve. The legs may have foot portions at their ends extending as cam followers axially along said inside surfaces of the knob sleeve, and may have end portions which interlock with the lug carrier to secure the spring in operating position.

The spring is especially adapted for use, and preferably used with, a knob keeper or driver or the like comprising a plate which is mounted for sliding movement transversely of the knob sleeve and carrying a knob-connector lug. In one embodiment, the plate is of rounded-E shape with a retainer lug projecting radially from its back side, which plate is mounted by such lug and its two side legs for radial movement in a plane normal to the axis of the knob sleeve, with such legs engaged in side slots in the knob sleeve and lying in straddle relation with a central clearance space for a throw member or other lock mechanism extending axially through the sleeve, and with a center tongue of the E-shape projecting radially inward toward such space. In another embodiment, the plate is a generally rectangular plate having a lug at one end, and is mounted in diametrically opposite circumferential slots in the knob sleeve, such plate has an opening to pass the bight of a biasing spring through the plane of the plate, and such opening may provide a central clearance opening. The plate is desirably formed with an inward projecting tongue for engagement by an open bight of the biasing spring. The tongue of a knob-keeper plate may extend into abutting relation with the throw member so as to block release movement of the keeper when the throw member is in place. The central bight of the spring in accordance with the present invention is preferably an open loop lying in an axial plane and engaged about the central tongue of the plate, the spring legs extend in a generally chordal direction along one side of the plate and preferably have their ends bent at an angle to form cam-follower portions adapted to ride on the cam faces of the sleeve. The ends of the spring legs may also be bent so as to extend through the plane of the plate and thence bent to form locking fingers extending along the opposite face of the plate to hold the spring in place against the plate while allowing its legs to swing resiliently outward to exert outward thrust against the converging inner cam faces of the two quadrants of the knob sleeve at the opposite side of such sleeve from the retainer lug.

Plates similar to those described above and shown in the accompanying drawings have previously been biased to lug-engaged position by bar springs such as the spring 62 shown in Best U.S. Pat. No. 3,955,387 of May 11, 1976, which spring is mounted over and under bridges formed in the wall of the cylindrical knob spindle, and has its free end engaged in an opening in the knob keeper. Such bar springs cause a number of problems. The formation of the bridge seats for them requires extra and exacting care in manufacturing the knob sleeve, and commonly requires a coining operation which would not otherwise be required, and the longitudinal slot weakens the tubular knob sleeve. If the seat and spring are not exactly formed and fitted, the spring may not be reliably held and may slip out of place and permit the knob to become disconnected from the knob sleeve. Also, if the spring is not properly seated against its bridge supports, it can cause the knob sleeve to bind and prevent proper operation of the lock, and can produce improper wear and early failure. Still further, the use of such bar springs is undesirable in many applications, and wholly infeasible in others. The present invention avoids such disadvantages and provides improved results.

The accompanying drawings illustrate the invention and show a preferred embodiment exemplifying the best mode of carrying out the invention as presently contemplated. In such drawings.

Figure 1:
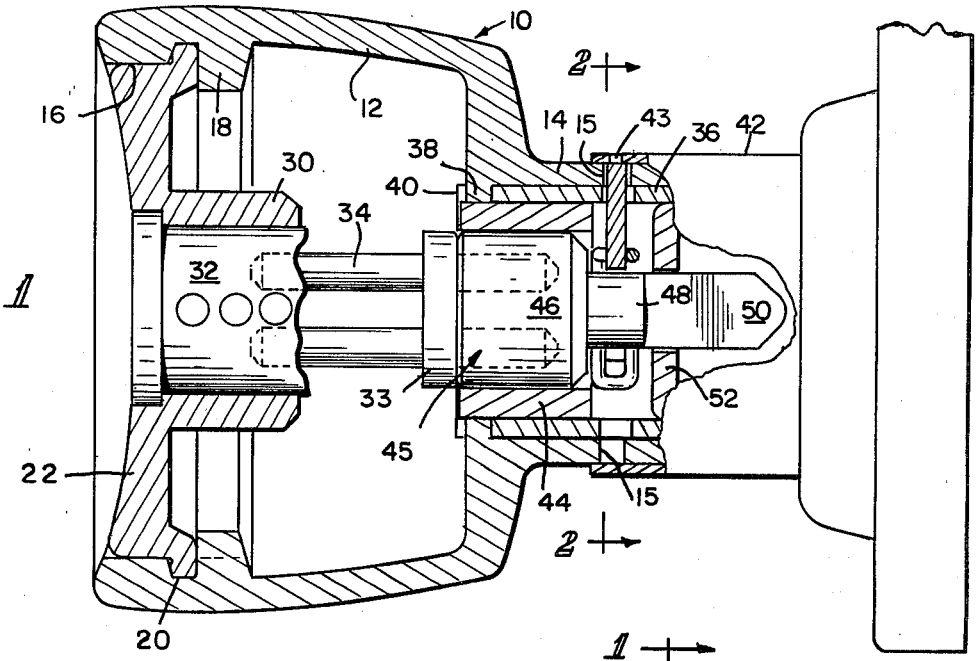
FIG. 1 is an axial section of a knob and its mounting and keeping mechanism in accordance with the invention, taken on the line 1—1 of FIG. 2.
Figure 3:
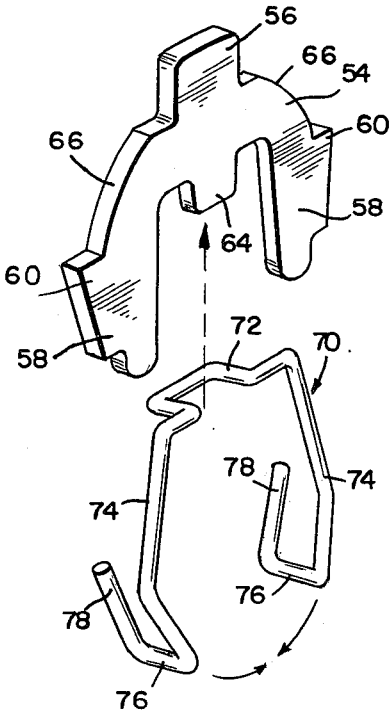
FIG. 3 is an exploded isometric view of the keeper plate and spring shown in FIGS. 1 and 2.
Figure 2:
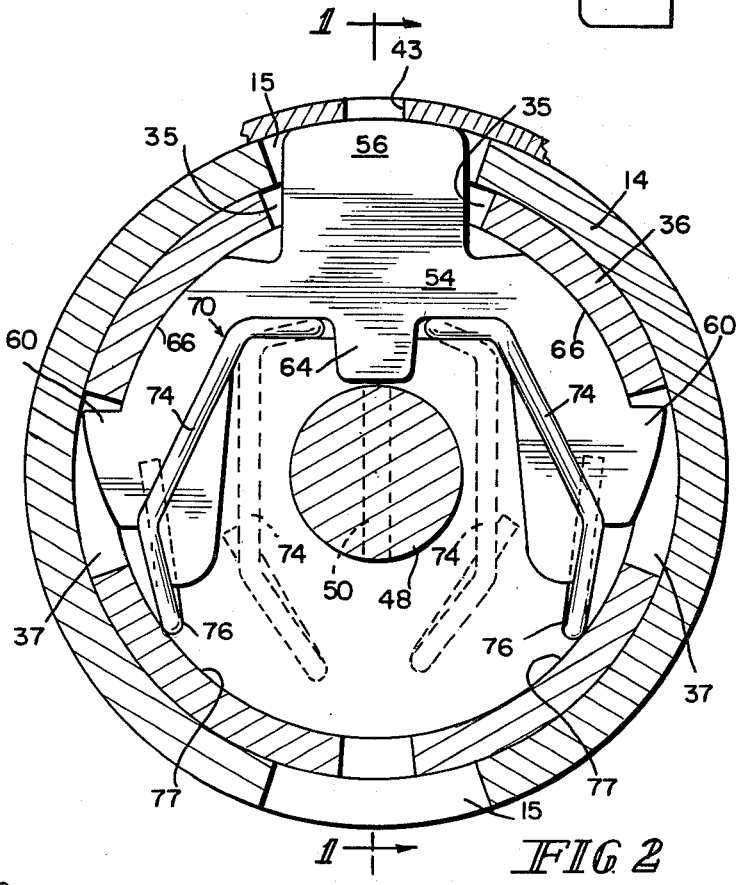
FIG. 2 is a section taken on the line 2—2 of FIG. 1.
Figure 5:
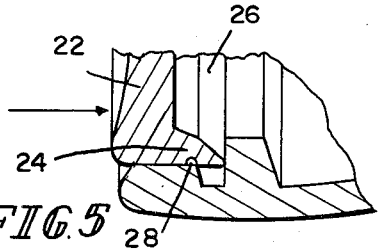
FIG. 5 is a fragmental sectional view showing the method of mounting the face plate in the knob of FIG. 1.
Figure 6:
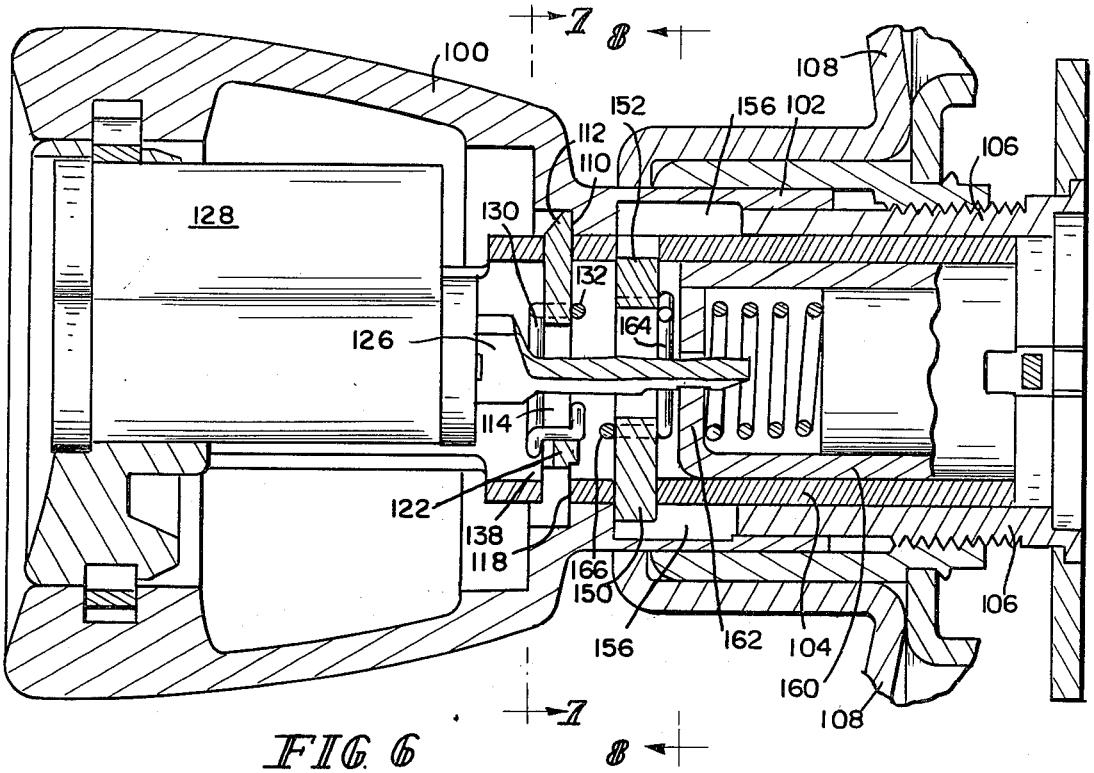
FIG. 6 is an axial section of a knob and its keeper and driver mechanism in accordance with the invention in which the keeper and its spring are modified from that shown in FIGS. 1–3 and in which torque is transmitted between the knob and the knob sleeve by a drive lug biased to engaged position by a spring in accordance with the present invention.

The mechanism shown in FIGS. 1–3 comprises a knob 10 having a handhold portion 12 and a neck portion 14. The handhold 12 is of heavy wall construction, formed with a large end opening 16 leading to an annular internal flange 18 and formed with an undercut 20 at the outer face of such flange 18. The outer end opening 16 is closed by a face plate 22 which is initially shaped as shown in FIG. 5 with an axially extending peripheral flange 24. Such flange desirably has an inside tapered face 26 and may have a stress concentration groove 28 in its outer periphery. The face plate is initially entered into the end opening 16 to bring its flange 24 into engagement with the outer face of the internal flange 18 of the knob handhold, as shown in FIG. 5, and is then pressed inward so as to cause its tapered axial flange to be deformed outward into the undercut 20 as shown in FIG. 1. The central portion of the end face 22 carries an inward extending cylindrical boss 30 which forms a seat for a key-removable core 32 as of the type shown in U.S. Pat. No. 3,955,387. As shown in FIG. 6 of that patent, such core is of Figure-8 cross section and includes a retaining lug (88 in that patent) which in the present structure engages behind the end of the cylindrical seat-forming boss 30. The core includes a key plug having a pair of rearwardly open holes for the reception of the throw pins 34 of a throw member 45 more fully described below.

Key-removable cores 32 are made in different lengths, with different numbers of pin tumbler columns. The knob is desirably made to accommodate the longest of such key-removable cores, and may be made to accommodate shorter cores by the insertion of spacers 33 mounted on the throw pins 34, so that the core with such spacers will hold the throw member 46 and especially its keeper-blocking section 48 in proper axial position in the assembly.

The knob 10 is mounted by means of its neck 14 on a tubular knob sleeve 36, to which it is keyed by inward extending keys 38 engaged in end notches 40 in the knob sleeve. The end of the knob neck 14 is surrounded by a trim collar 42.

The outer end of the knob sleeve is desirably mechanically strengthened by the insertion therein of a generally cylindrical support ring 44, and this serves as a bearing support for the cylindrical body 46 of the throw member 45 in which the throw pins 34 are fixed. The throw member has a cylindrical portion 48 of reduced diameter extending inward through the plane of the knob keeper, as described below, and has a flattened spade 50 engaged in a transverse slot in a key-actuated roll-back sleeve 52.

The knob neck 14 is retained on the knob sleeve 36 by a knob keeper or retainer 54 best shown in FIGS. 2 and 3. This is a plate of generally rounded-E shape with a keeper lug 56 projecting from its back side in position to enter a keeper slot 15 in the neck. Its side legs 58 are formed with laterally projecting guides 60 and stand in widely spaced relation to clear a central clearance space through which the throw member portion 48 extends along the axis of the knob sleeve 36. Such knob keeper 54 is mounted for radial movement in a plane normal to the axis of the sleeve 36, by engagement of its radial lug 56 through an upper slot 35 and engagement of its guides 60 in coplanar side slots 37. The center tongue 64 of the E-shaped retainer projects radially inward opposite the outward projecting keeper lug 56 and lies in blocking relation with the throw member portion 48 to prevent retraction of the retainer 54 when the throw member is in its normal position. The retainer plate has rounded shoulders 66 which abut the inside faces of the two upper quadrants of the knob sleeve 36 when the retainer plate is in its normal knob-retaining position as shown in FIGS. 1 and 2.

The knob-retainer plate 54 is biased to this normal knob-retaining position by a spring 70. Such spring has a central bight 72 in the form of an open loop lying in an axial plane and adapted to embrace the center tongue 64 of the knob keeper 54. From the ends of that bight loop 72, the spring extends outward and downward, generally chordally of the sleeve 36, to form two downwardly diverging legs 74 which straddle the central clearance space in the knob sleeve. At the lower ends of the leg 74, the spring wire is bent to form axial foot portions 76 extending through the plane of the retainer plate 54 and is then bent upward to form interlock portions 78, which overlie the back face of the plate to hold the spring in place. When assembled with a keeper plate 54 in a knob sleeve 36, the central bight loop 72 embraces the center bar 64 of the keeper plate, its legs 74 extend along the front face of the keeper plate, its foot portions 76 extend back through the plane of the keeper plate, and the interlock or toe portions 78 extend upward behind the back face of the keeper plate so that the spring is interlocked with the plate. In such position, the foot portions 76 bear as cam followers against the downward converging inner faces of the two lower quadrants of the knob sleeve, which form cam faces, and the spring is stressed so that such foot portions exert outward pressure against those cam faces in a camming relation which generates an upward component of force to bias the spring and knob keeper 54 upward to its normal position with its shoulder 66 bearing against the inner faces of the two upper quadrants of the knob sleeve 36. The lower quandrants thus provide cam faces 77 against which the foot portions 76 react with outward force so as to generate an upward biasing component of force for the knob keeper 54.

The knob keeper 54 is adapted to be moved to knob-releasing position by the insertion of a suitable tool through an opening 43 in the collar 42, to press inward on the keeper lug 56. Since the knob keeper 54 is normally blocked from inward movement by the blocking relation of its central bar 64 against the cylindrical portion 48 of the throw member, before removing the knob it is first necessary to remove the key-removable core 32 from its seat in the face plate 22 of the knob handhold and then to withdraw the throw member 46 from the assembly. This clears the central clearance space along the axis of the knob sleeve 36 so that the knob keeper 54 can then be pressed inward to a knob-releasing position. In its inward movement, it presses inward on the central bight portion 72 of the spring, and this causes the foot portions 76 to ride downward on the cam faces 77 on the lower two quadrants of the knob sleeve and forces the ends of the legs inward against the stress in the spring.

The knob keeper 54 and the spring 74 are assembled in the knob sleeve 36 with the knob 10 removed from that knob sleeve. For purposes of such assembly, the knob-keeper plate 54 is initially formed with its legs bent inward from the position shown in FIGS. 2 and 3, so that its guides 60 will clear the inner diameter of the knob sleeve 36. The knob keeper 54 is then inserted into the open end of the knob sleeve, its keeper lug 56 is inserted outward through the slot 35 in such knob sleeve, and its guides 60 brought into alignment with the side slots 37 in such sleeve and the legs 58 are then bent outward to carry the guides 60 into those slots 37, so that the knob keeper will then be mounted for radial sliding movement in the plane of the slots, normal to the axis of the knob sleeve 36. The spring 70 is then partially collapsed with a suitable tool and is inserted through the open end of the knob sleeve 36. It is manipulated to first engage its bight loop 74 behind the center leg 64 of the knob keeper. When so collapsed, the spring legs 74 are yieldingly bent inward to the dotted line positions 74 shown in FIG. 2, which allows their interlock portions 78 to be passed through the plane of the knob keeper 54.

The spring is then allowed to expand so that its leg portions lie along the front face of such keeper 54 and its interlock portions 78 lie behind the opposite face of that keeper, and its foot portions 76 lie as cam followers axially along the arcuate camming surfaces 77 of the sleeve.

When the knob 10 is mounted on the knob sleeve, its neck 14 is slidably engaged over the outer end of such sleeve and moved rearward. The keeper lug 56 is suitably pressed inward to a clearance position, which allows the neck to move to its proper assembled position, with its keys 38 engaged in the end slots 40 of the knob sleeve. The knob will then be in proper aligned position, with its keeper lug receiving opening 15 aligned with the slot 35 of the knob sleeve so that the keeper lug 56 can be moved by the spring into its knob-retaining position as shown in FIGS. 1 and 2. Preferably, lug-receiving openings 15 are provided at diametrically opposite sides of the knob neck 14, to permit the knob to have different orientations to suit doors of different hand.

The relative orientations of the knob and its key-removable core 32, the knob key 38 and knob sleeve slot 40, the knob keeper 54 and its keeper lug 56 in relation to the neck 14 and especially in relation to the tool-insertion opening 43 in the trim collar 42 for depressing the knob keeper, are all shown for purposes of convenient illustration, and it will be understood that different orientations may be used. For example, the tool insertion opening 43 may be displaced circumferentially from alignment with the keeper lug 56, so that it is necessary to have the knob in an unlocked position and rotated to a different orientation in order to insert the keeper-actuating tool. Also, the tool-insertion opening 43 may be omitted from the collar 14 so that the keeper 54 can be released only by first removing the key-removable core 32 with a special control key, then removing the throw member 46, and then inserting a tool through the core chamber and actuating the knob keeper to released position from inside the knob sleeve.

Figure 4:
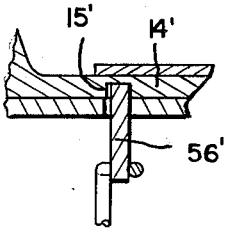
FIG. 4 is a fragmental sectional view taken in the plane of FIG. 1 showing a modification in which the knob keeper lug is engaged in a blind hole in the knob neck.

A further alternative is shown in FIG. 4, in which the keeper lug 56' is somewhat shorter than the lug 56 shown in FIGS. 1 and 2, and the opening 15' formed in the neck 14' for the reception of that keeper lug 56' is a blind opening which does not extend through to the outside of the neck 14'. The keeper lug will then be completely concealed by the neck, and the knob can be removed only by first removing the key-controlled core 32 and the throw member in order to insert a tool to retract the knob keeper from inside the knob sleeve.

Figure 7:
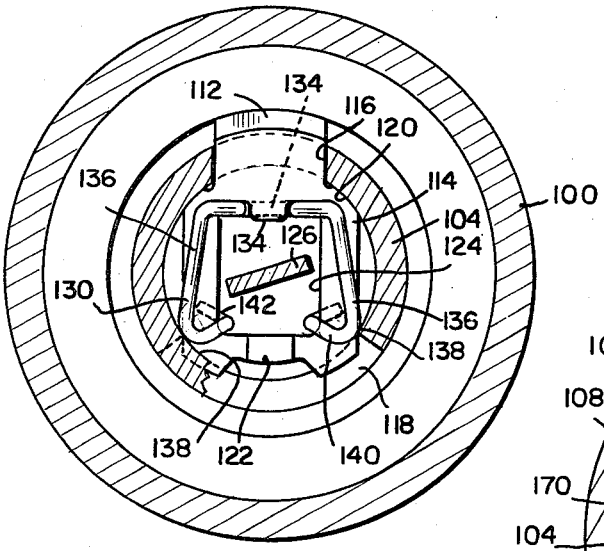
FIG. 7 is a section taken on the line 7—7 of FIG. 6 and showing the knob-keeper mechanism.
Figure 8:
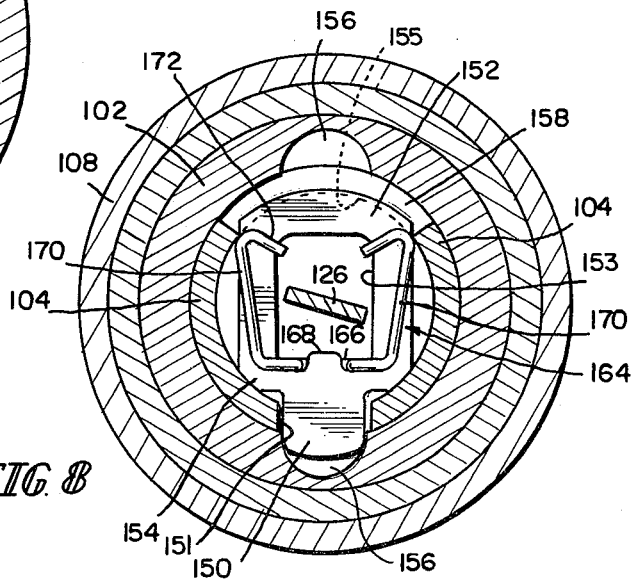
FIG. 8 is a section on the line 8—8 of FIG. 6, showing the knob-driver mechanism.

The embodiment of the invention shown in FIGS. 6–8 comprises a knob 100 mounted by its neck 102 on a knob sleeve 104 rotatably mounted in a hub 106, and with the knob neck surrounded by a mounting assembly including an escutcheon 108. Near the handhold end of the knob neck, such neck is formed with a circumferentially continuous shoulder 110 facing toward the outer end of the knob, and this is engaged by a keeper lug 112 carried by a plate 114. The lug 112 is slidably received in a circumferential slot 16 at the upper side of the knob sleeve 104, and the wider plate 114 has its lower end received in a diametrically opposite circumferential slot 118, so that the plate 114 is mounted for transverse sliding movement in the knob sleeve. At the base of the lug 112, the wider plate 114 forms shoulders 120 which abut the inner surface of the knob sleeve 104 to stop the sliding movement of the retainer lug and plate in a position of engagement with the shoulder 110 on the knob. The lug and plate are slidably insertable in the knob sleeve 104 through the wider slot 118, and may be locked against removal by forming an offset 122 in the lower portion of the plate. The retainer plate 114 has a central clearance opening 124 to pass the throw member 126 connected to the key plug of the core 128 mounted in the knob.

The retainer lug and plate are biased to knob-engaged position by a spring 130 having a central bight 132 engaged about an inward-extending tongue 134 in the opening of the plate 114, and having side legs 136 which extend outward and downward into engagement with downwardly converging cam faces 138 adjacent the edge of the slot 118. The end portions 140 of the legs 136 are bent inward and partly back on themselves in the plane of the legs 136, and thence bent axially through the clearance opening 124 of the plate, and thence outward to form retaining fingers 142 interlocked against the back face of the plate to retain the spring against the front face of the retainer plate. When the spring is in mounted position as shown in FIG. 7, its legs 136 are stressed inward, and exert resilient force outward against the cam faces 138 so as to create an upward component of force which is transmitted through the spring to the upper portion of the retainer plate to bias the retainer lug in the knob-engaged position. The spring may be assembled to the retainer plate in a manner analogous to that illustrated in FIG. 2, by mechanically holding the legs 136 together sufficiently to pass the locking fingers 142 through the clearance opening 124, and then permitting the spring to expand to the position shown in FIG. 7.

In this embodiment, the knob 100 is drivingly connected to the knob sleeve 104 by a driver lug 150 carried on a drive plate 152 mounted for transverse sliding movement in the knob sleeve 104 in a manner analogous to that of the retainer plate 114 and provided with stop shoulders 154 which engage the inner faces of the knob sleeve 104 to stop the outer movement of the drive lug 150 in engagement with one of a pair of axial slots 156 in the neck 102 of the knob. The drive lug 150 and the slots 156 which it engages are so shaped that if excessive torque is applied to the knob, the drive lug will retract from its slot 156 and allow the knob to rotate about the knob sleeve so as to prevent damage to the lock mechanism or forced entry through the door in which it is mounted. For convenience of illustration, the drive lug 150 is shown at a position 180° from the retainer lug 112, but this is a matter of convenience only, and it is an advantage of the present invention that the spring does not impose limitation on the orientation of the parts which it biases to operative position.

The plate 152 has a central clearance opening 153 to pass the key-actuated throw member 126, and its broad end is slidably received in a circumferential slot 158 diametrically opposite from the slot 151 in which the drive lug 150 is received. The drive plate and lug are thus mounted for transverse sliding movement in the sleeve 104, and are located in a predetermined transverse plane in that sleeve. The inner end of the sleeve 104 contains a roll-back cam sleeve 160 having an end wall 162 in which the key-actuated throw member 126 is engaged so that key rotation of that throw member will rotate the cam sleeve 160 to retract the lock bolt in known manner. In the present structure, the end wall 162 of the cam sleeve 160 is spaced sufficiently from the drive plate 152 to clear and retain the biasing spring 164 for the drive plate. The biasing spring 164 is formed with a central bight 166 engaged about an inward-extending tongue 168 on the drive plate 158 and has side legs 170 which extend outward and upward in clearance relation with the clearance space 153 of the drive plate and into engagement with upwardly converging inner faces of the knob sleeve 104. In this case, since the spring legs 170 are trapped between the drive plate and the end wall 162 of the roll-back cam sleeve, the ends 172 of those legs are bent inward and back upon themselves in the same plane, and the spring is not interlocked with the drive plate as in the case of the retainer plate shown in FIG. 7.

As in the other embodiments, when the spring is in place as shown in FIG. 8, the spring legs 170 are stressed so as to exert an outward thrust against the upward converging cam surfaces 155 adjacent the slot 158, and thereby generate a downward thrust on the drive plate 152 and the drive lug 150 to bias such lug into engaged position with the groove 156 in the knob neck. The knob spring 164 may be assembled in operative position by inserting it through the inner end of the knob sleeve 104 before the roll-back cam sleeve 160 is inserted in the knob sleeve.

The operation of the springs 130 and 164 in this modification is analogous to that in the modification of FIGS. 1–3. The legs of the springs are under tension and exert an outward thrust against converging inside cam faces of the knob sleeve, and thereby create a component of force biasing the retainer or drive lug to its engaged position. When the lug is thrust inward against such biasing force, the ends of the legs ride down upon the converging cam faces and are cammed inward along those surfaces, and when the inward thrust on the lock is removed, the ends of the legs move outward and upward along those faces to return the lug and its supporting plate to normal engaged position.

I claim:

1. Knob-connector mechanism for connecting a doorknob on a tubular knob sleeve or the like, comprising a knob-connector mounted for movement radially of the knob sleeve to a knob-connecting position, and means for biasing the connector to such position, characterized in that said biasing means comprises a wire spring having a central bight portion in outward radial thrust relation with said connector and disposed adjacent one side of the knob sleeve, said spring also having side legs connected to said bight portion and extending therefrom in free-clearance relation across to the opposite side of the knob sleeve and there engaged in spaced lateral thrust relation with inside surfaces of the sleeve so that such lateral thrust of the spring legs reacts against such surfaces as cam surfaces to produce a component of force on the spring in the direction of outward radial movement of the connector.

2. Knob-connector mechanism as in claim 1, further characterized in that the side legs of the spring straddle a central clearance area along the axis of the knob sleeve.

3. Knob-connector mechanism as in claims 1 or 2, further characterized in that the side legs have foot portions at their ends extending as cam followers axially along said inside surfaces of the knob sleeve.

4. Knob-connector mechanism as in claim 2 in which the connector is a knob keeper having an abutment face presented inward between the legs of the spring and adapted to abut a lock element in said clearance space so that such element blocks movement of the keeper against inward movement.

5. Knob-connector mechanism as in claim 1 in which the knob-connector has an inward projecting tongue and said bight portion is a loop engaged about such tongue.

6. Knob-connector mechanism as in claim 1 in which the connector is a plate-like member, further characterized in that the spring lies against one side of the plate, the bight of the spring extends through the plane of the plate and has a portion overlying its opposite side, and each spring leg is bent to extend through the plane of the plate and thence to provide a portion overlying such opposite side so as to interlock the spring against displacement from the plate.

7. Knob-connector mechanism as in claim 6 in which the keeper has an inward projecting tongue between its side portions, and said bight portion is a loop engaged about such tongue.

8. Knob-connector mechanism as in claim 1 in which said connector is a plate-like member having side portions extending toward said cam surfaces, further characterized in that the bight portion of the spring extends axially through such keeper in interlocked relation therewith, and each spring leg extends along one face of a connector side portion, thence through the plane of the keeper and thence along the opposite face of the leg so that the spring is interlocked against axial displacement from the keeper.

9. Knob-connector mechanism as in claim 8 in which said plate side portions terminate short of the cam surfaces, said bight portion is a U-shaped loop and said spring side legs extend along the same side of the keeper and have foot portions extending across the ends of the plate side portions and toe portions extending upward along the opposite side of the keeper, the foot portions including axially extending portions in camming engagement with said camming surfaces of the knob sleeve.

10. Knob-connector mechanism as in claim 1 in which the connector is a plate-like member, said springs extending along one face of such member and being bent inward at their ends so as to present rounded cam follower surfaces in contact with the cam surfaces, and means to retain the spring in place.

11. Knob-connector mechanism as in claim 10 in which the plate-like member has an open center portion, and the inward-bent ends carry further end portions which extend through such open center portion and thence into overlying relation with the back face of the plate-like member to retain the spring in place.

12. Knob-connector mechanism for retaining a doorknob against axial or circumferential movement on a tubular knob sleeve or the like, comprising a knob-connector plate mounted for radial movement in a transverse plane in the knob sleeve and having a connector lug projecting radially from the sleeve for engagement with a surrounding knob portion, said plate also having a central tongue projecting inward from such lug, wherein the improvement comprises a biasing spring for biasing the lug to outward knob-engaging position, said spring having a central U-shaped bight engaged about said central tongue, and side legs extending oppositely outward and downward in generally chordal relation with the knob sleeve to the opposite side of the knob sleeve and there having end portions engaged in lateral thrust relation with inside camming surfaces of the sleeve so that such lateral thrust of the spring legs reacts against such surfaces to produce a component of force biasing the spring in the direction of outward radial movement of the keeper.

13. Knob-connector mechanism as in claim 12 in which the plate has a clearance opening centrally of the knob sleeve, the spring legs extending along one face of the plate and having end portions extending through the plane of the plate and overlying the rear face thereof to lock the spring against displacement.

14. Knob-connector mechanism as in claim 13 in which the plate has side portions which stop short of the camming surfaces and the end portions of the spring extend axially through the plane of the spring along the camming surfaces and thence upward along the rear faces of the plate.

15. Knob-connector mechanism as in claim 13 in which the plate extends into close proximity to the camming surfaces and has a central clearance opening, and the end portions of the spring extend into engagement with such surfaces and thence inward and through such clearance opening and thence into overlying relation with the rear face of the plate.

16. Knob-connector mechanism for retaining a doorknob on a tubular knob sleeve or the like having a lug-receiving opening at one side thereof, comprising a connector lug disposed in said opening and movable radially between projected and retracted positions, and means for biasing the lug to projected position, including a pair of spring side legs operatively connected to said lug in outward thrust relation therewith and extending in free-clearance relation across to the opposite side of the knob sleeve and there engaged in spaced lateral thrust relation with inside camming surfaces of the sleeve so that such lateral thrust of the spring legs reacts against such surfaces to produce a component of force on the spring in the direction of outward radial movement of the lug.

* * * * *